US006021539A

United States Patent [19]

Zhadanov et al.

[11] Patent Number: 6,021,539

[45] Date of Patent: Feb. 8, 2000

[54] WASHING DEVICE

[76] Inventors: Eli Zhadanov; Sam Zhadanov, both of 2944 W. 5th St. Apt. 20J, Brooklyn, N.Y. 11224

[21] Appl. No.: 08/963,162

[22] Filed: Nov. 3, 1997

[51] Int. Cl.[7] ..... A46B 13/06

[52] U.S. Cl. ..... 15/29; 16/115

[58] Field of Search ..... 15/29, 24, 144.4; 401/203, 289; 16/115; 601/112, 114

[56] References Cited

U.S. PATENT DOCUMENTS

| | | | |
|---|---|---|---|
| 352,009 | 11/1886 | Seery | 401/289 |
| 3,114,164 | 12/1963 | Riordan | 15/29 |
| 4,228,558 | 10/1980 | Zhadanov | 15/29 |
| 4,461,052 | 7/1984 | Mostul | 15/29 |
| 4,734,954 | 4/1988 | Greskovics et al. | 15/29 |
| 4,780,922 | 11/1988 | Sanchez | 15/29 |
| 5,289,605 | 3/1994 | Armbruster | 15/144.4 |
| 5,336,012 | 8/1994 | Newville | 401/289 |

FOREIGN PATENT DOCUMENTS

| | | | |
|---|---|---|---|
| 2354981 | 5/1975 | Germany | 401/289 |

*Primary Examiner*—Gary K. Graham
*Attorney, Agent, or Firm*—Ilya Zborovsky

[57] ABSTRACT

A hand-held washing device has a housing, a rotor rotatable in the housing, a washing tool attached to the rotator and rotatable therewith, a holder connected with the housing, and a handle telescopably connected with the holder.

8 Claims, 3 Drawing Sheets

WASHING DEVICE

BACKGROUND OF THE INVENTION

The present invention relates generally to washing devices.

More particularly, it relates to washing devices which operates on the principle of water pressure used for both spraying of water and mechanical work in form of a rotating tool.

Known shower devices are designed namely for various types of spraying of water, including water pulsation. The utilization of water pressure for mechanical treatment of surfaces is predominantly used in a household industry for washing of cars, furniture, etc. Such designs are described in U.S. Pat. Nos. 4,480,922; 2,678,457; 5,007,127; 5,129,121 etc. The combination of the rotation with spraying was first described in U.S. Pat. Nos. 4,228, 5,88; 4,374,444; 5,619, 766. The constructions disclosed in these patents are based on a mechanical treatment surfaces with a rotating tool, and devices designed exclusively for massage and washing by rotary tool are designed on this principle.

It is believed to be desirable to further improve the existing devices of this type.

SUMMARY OF THE INVENTION

Accordingly, it is an object of the present invention to provide a washing device which is a further improvement of the existing devices.

In keeping with these objects and with others which will become apparent hereinafter, one feature of present invention resides, briefly stated, in a hand-held washing device which includes a housing; a rotor rotatably arranged in said housing and having a plurality of blades so that when water passes through said housing said rotor rotates under the action of water, a washing tool attached to said rotor so as to rotate together with said rotor and to allow water to exit from said housing; an elongated holder connected with said housing; and a handle telescopably movable on said holder so as to increase and reduce a joint length of said handle together with said holder to make therefore comfortable washing a part located close to said washing device when the joint length of said holder and said handle is reduced and to wash a part located further from the device when the joint length of said holder and said handle is increased.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
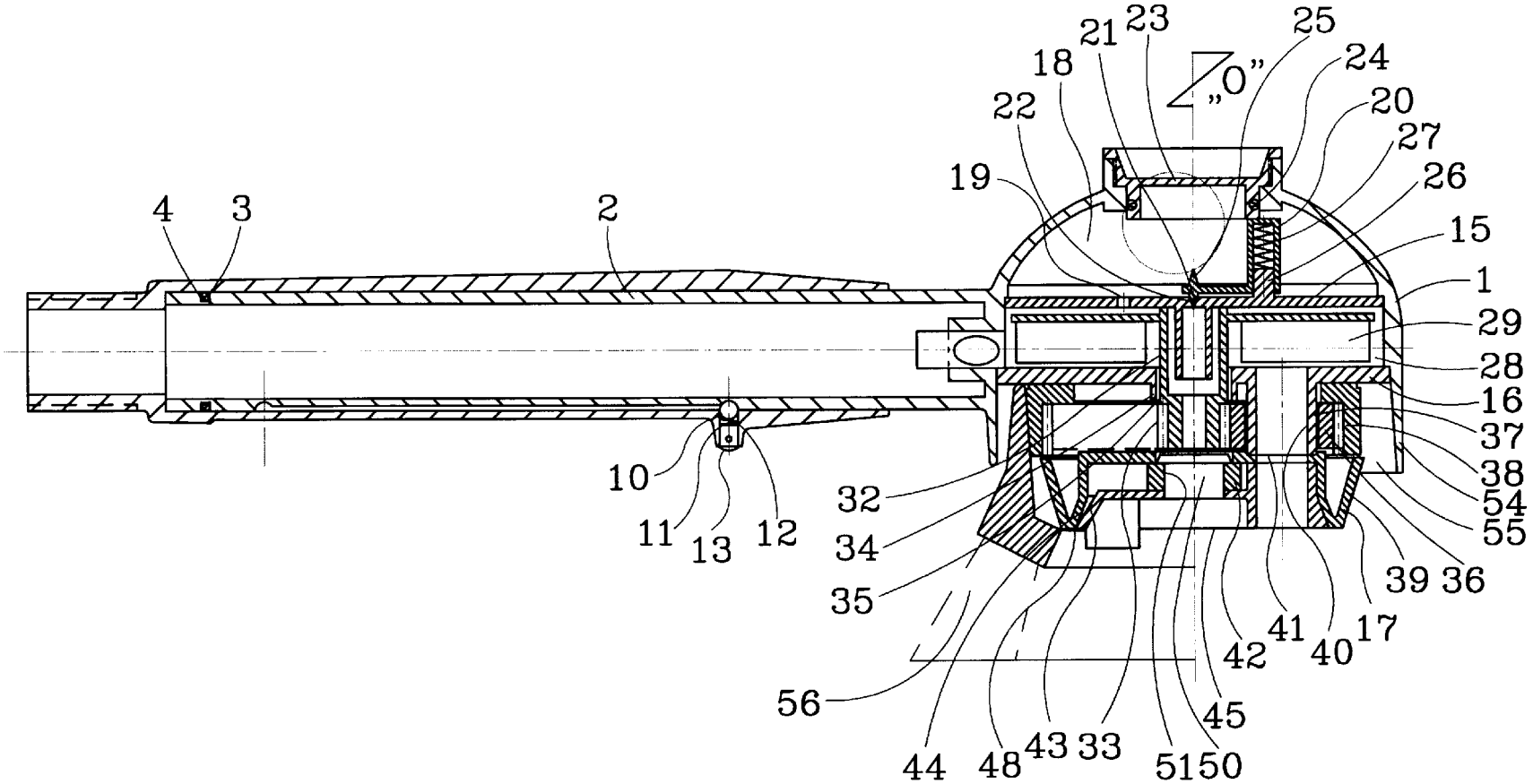
FIG. 1 is a view showing a cross-section of a washing device in accordance with the present invention.

A hand-held washing device in accordance with the present. invention has a housing 1 shown in FIG. 1 and formed of one piece with a holder 2. A holder 2 has a ring groove 3 with a seal 4 at its end. The outer surface of the holder has a groove 5 with spherical depressions 6 and 7 at its ends.

A handle 8 is slidingly fitted on the holder and has one end provided with a thread 9 for connection with a flexible hose. The front part of the handle is provided with a spherical fixing member 10 shown in FIG. 1. It is spring-biased by a spring 11 toward the groove 5. The spring is arranged in an opening 12 and fixed by a rivet 13.

Figure 3:
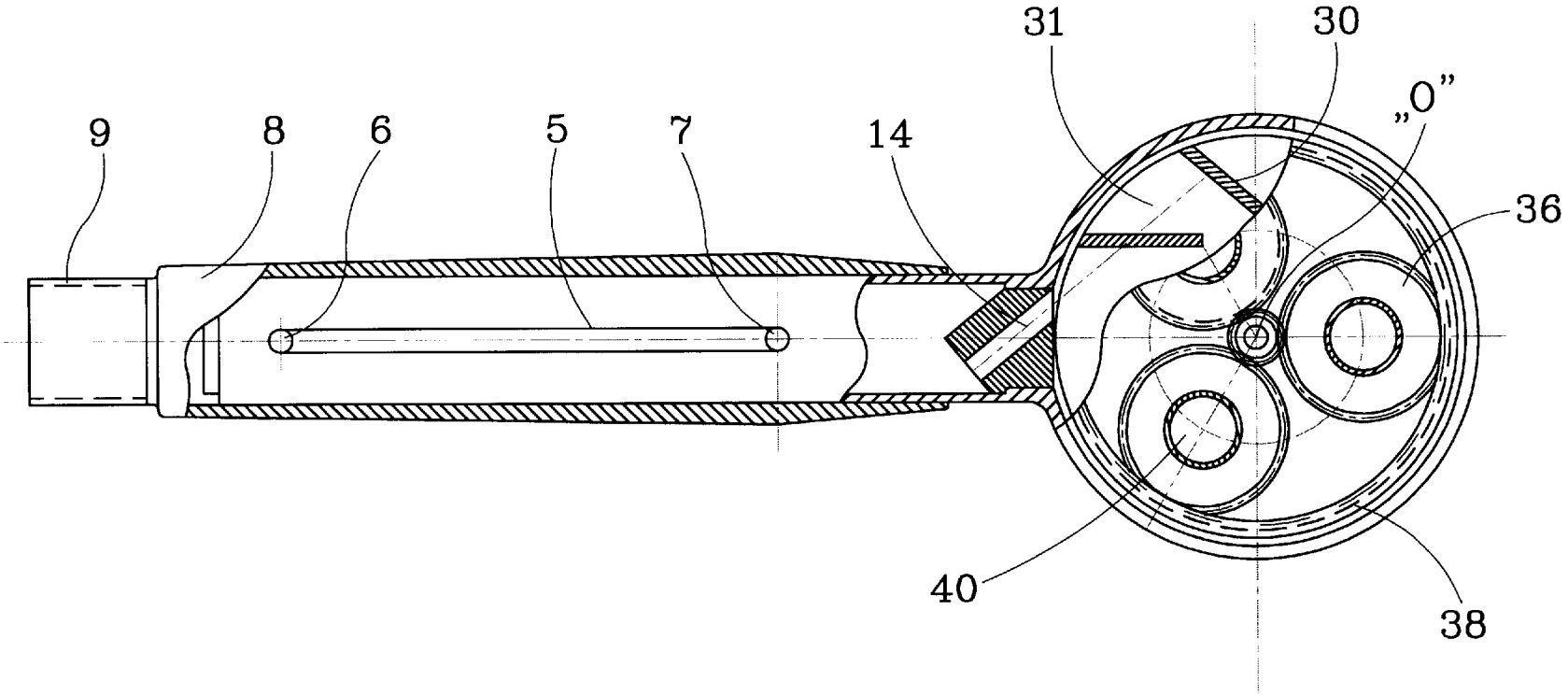
FIG. 3 is a view showing a cross-section of the washing device in a plane which is perpendicular to the plane of the cross-section of FIG. 1.

In the zone of connection of the holder with the housing a water pressure opening 14 or an injector shown in FIG. 3 is arranged at an angle relative to the axis of rotation. Its diameter and length are selected in accordance with the law of hydraulics to provide a concentrated flow of water as disclosed in U.S. Pat. No. 4,228,558 which is incorporated here as a reference.

The housing is subdivided by partitions 15, 16, 17 into two sections. The first section 18 is provided for preparing perfumery or medical solutions. It has a water pressure opening 19 and an adjusting valve 20 with a needle tip 21 which overlaps the outlet conical opening 22 under the action of a threaded block 23 with a seal 24. The other end of the member 25 which is opposite to the needle point 21 operates for piercing of a shell of substance-containing elements, such as for example hollow spherical containers with perfumery, medical and other substances. The valve 20 which is arranged on an axial 26 of the partition 15 is open by the spring 27.

The second section 28 is a working section of the rotor. The rotor 29 has eight open blades 30 which are shown in FIG. 3 and arranged on a disk 31 at an angle to the axis of rotation. The rotor has a hollow pin 32 which is connected with the disk of the slide of the blades and ends in a gear 33.

The partition 16 which separates the second and the third sections has a central hub 34 shown in FIG. 1. A pin of the rotor 32 with the gear 33 extends through the opening of the hub 34 into the third zone and engages with three gears 36 arranged on three hollow axials 37 mounted on the partition 16 so as to form a planetary transmission together with a gear 38 having inner teeth.

Figure 2:
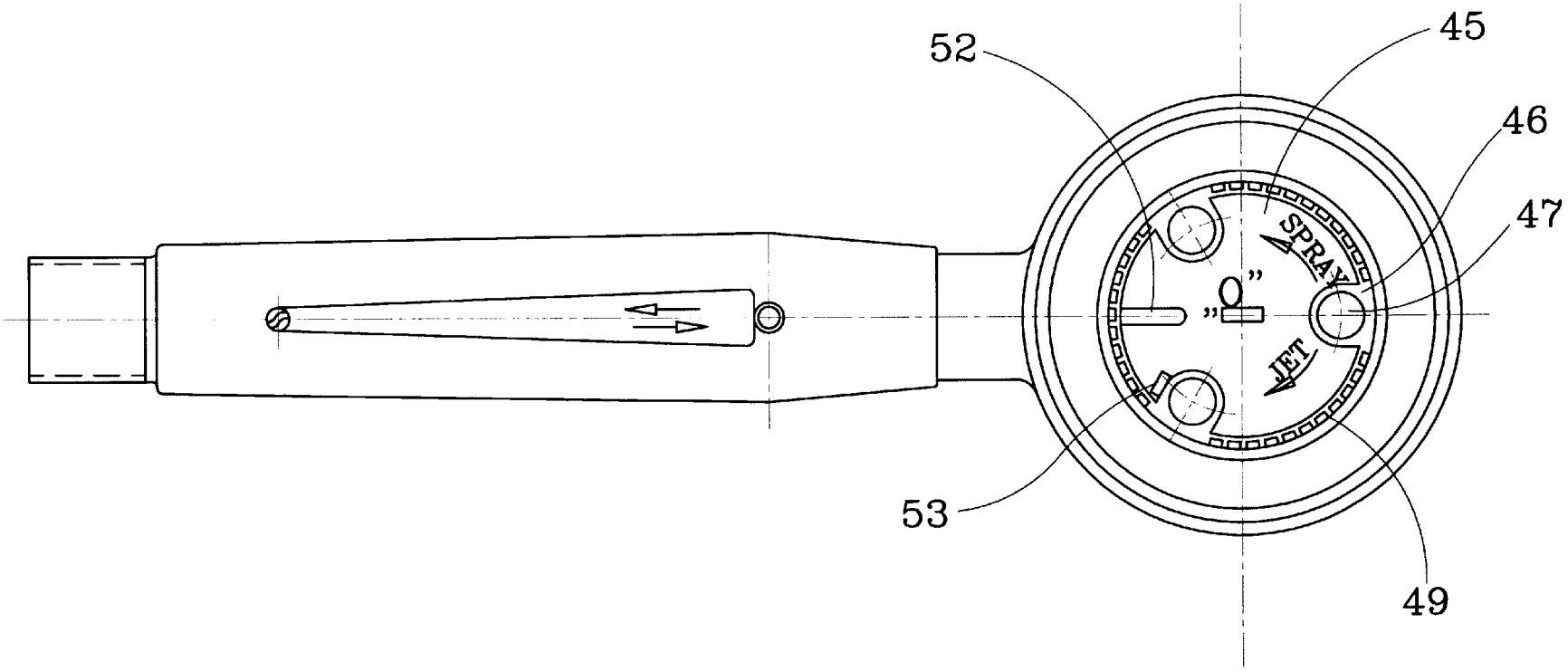
FIG. 2 is a bottom view of the inventive washing device from below of FIG. 1.

The outer surface of the gear 38 has a two degree cone (morse cone) and used for mounting of a rotary tool. The planetary mechanism is closed by a flange 17 which has a conical surface 39 for guiding the tool when it is to be mounted. The flange is arranged on two hollow axles 37 which have a hollow surface 40 and is centered by three openings 41. A hollow hub 42 is arranged at the center of the flange. The side surface of the flange has a conical surface 43 which, in combination with the surface 44 of a diffusor 45 shown in FIG. 2 forms an opening of a shower stream. The diffusor 45 has three projections 46 with openings 47 which coaxial with the openings 40 and 41 in FIG. 1.

Conical grooves 48 are provided on the lateral conical surface of the diffusor in three sectors over its periphery. In combination with the surface 43 of the flange 17 the conical grooves 48 form openings for a shower stream 49. The mounting of the diffusor to the flange is performed by a central split axle 50 in an opening 51 by a snap on. Turning of the diffusor from the position "spray" to the position "jet" is performed by a handle 52 and fixed by a stop 53.

The rotary mechanism located in the third zone is protected by a side wall 54 of the cylindrical position of the housing 1, with a side gap 55 formed between the wall of a cylinder and a lateral conical surface 39 of the flange 17. The working tool 56 is engaged in this gap when the device is used for a mechanical treatment.

It will be understood that each of the elements described above, or two or more together, may also find a useful application in other types of constructions differing from the types described above.

While the invention has been illustrated and described as embodied in washing device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hand-held washing device, comprising a one piece housing with a water inlet; a rotor rotatably arranged in said housing for rotation about an axis and having a plurality of blades so that when water passes through said housing said rotor rotates under the action of water, a washing tool attached to said rotor so as to rotate together with said rotor and to allow water to exit from said housing; an elongated holder connected with said housing; and a handle telescopably movable on said holder so as to increase and reduce a joint length of said handle together with said holder to make therefore comfortable washing a part located close to said washing device when the joint length of said holder and said handle is reduced and to wash a part located further from the device when the joint length of said holder and said handle is increased, said housing divided into first and second sections by a partition, said first section defines a chamber for housing perfumery or medical solutions and said second section contains said rotor and said inlet, said chamber is provided spaced above said rotor along said axis, wherein said axis passes through said partition and said chamber, fluid communication means is provided in said partition to enable passage of said solutions from said chamber to said tool, said holder being of one piece with said housing.

2. A hand-held washing device, comprising a housing with a water inlet; a rotor rotatably arranged in said housing and having a plurality of blades so that when water passes through said housing said rotor rotates under the action of water, a washing tool attached to said rotor so as to rotate together with said rotor and to allow water to exit from said housing; an elongated holder connected with said housing; a handle telescopably movable on said holder so as to increase and reduce a joint length of said handle together with said holder to make therefore comfortable washing a part located close to said washing device when the joint length of said holder and said handle is reduced and to wash a part located further from the device when the joint length of said holder and said handle is increased; and means for guiding said handle on said holder during movement of said handle relative to said holder, said guiding means including a groove provided on a surface of one of said holder and said handle, and a spring biased fixing member guidingly engageable in said groove.

3. A hand-held washing device as defined in claim 2, wherein said groove is provided on an outer surface of said holder, while said fixing member is arranged movably in said handle in direction transverse to a longitudinal direction of said holder and said handle.

4. A hand-held washing device as defined in claim 2; and further comprising means for fixing said handle relative to said holder in two end positions including a first position in which the joint length of said holder and said handle is minimal and a second position in which the joint length of said holder and said handle is maximal, said fixing means include two depressions located at opposite ends of said groove, so that said fixing member is engageable in each of said depressions and can be withdrawn from each of said depressions by force movement of said handle relative to said holder in the longitudinal direction.

5. A hand-held washing device, comprising a housing with a water inlet; a rotor rotatably arranged in said housing and having a plurality of blades so that when water passes through said housing said rotor rotates under the action of water, a washing tool attached to said rotor so as to rotate together with said rotor and to allow water to exit from said housing; an elongated holder connected with said housing; a handle telescopably movable on said holder so as to increase and reduce a joint length of said handle together with said holder to make therefore comfortable washing a part located close to said washing device when the joint length of said holder and said handle is reduced and to wash a part located further from the device when the joint length of said holder and said handle is increased; and means for transmitting a rotation of said rotor to said tool and including a central toothed hub connected with said rotor, a plurality of toothed gears engaging with teeth of said hub so as to form a planetary mechanism, and an outer gear with inner teeth engaging with teeth of said plurality of gears, said outer gear having an outer surface which is spaced from an inner surface of said housing so as to form a gap, said tool being insertable in said gap.

6. A hand-held washing device as defined in claim 5; and further comprising a flange covering said housing, said flange having an inclined outer surface leading to said gap so as to facilitate insertion of said tool into said gap.

7. A hand-held washing device as defined in claim 6; and further comprising a diffusor having thoroughgoing openings and a plurality of circumferentially arranged slots, said diffusor being turnable between a first position in which said openings are open so as to allow water to flow through said openings and to form a water spray, and another position in which said openings are closed and water flows through said grooves to provide a plurality of water jets.

8. A hand-held washing device comprising, a housing with a water inlet; a rotor rotatably arranged in said housing and having a plurality of blades so that when water passes through said housing said rotor rotates under the action of water, a washing tool attached to said rotor so as to rotate together with said rotor and to allow water to exit from said housing; an elongated holder connected with said housing; a handle telescopably movable on said holder so as to increase and reduce a joint length of said handle together with said holder to make therefore comfortable washing a part located close to said washing device when the joint length of said holder and said handle is reduced and to wash a part located further from the device when the joint length of said holder and said handle is increased, said housing having a first section for preparing perfumery or medical solutions, and a second section for accommodating said rotor with said blades; and a valve having a needle tip adapted alternatively to close and to open an opening communicating said first housing section with said second housing section for admitting the perfumery or medical solutions from said first housing section into said second housing section or preventing the same, said valve also having a needle point facing toward an interior of said first housing section and operating for piercing shells of substance-containing elements which are supplied into said first housing section.

* * * * *